United States Patent [19]

Damiana

[11] Patent Number: 4,482,178

[45] Date of Patent: Nov. 13, 1984

[54] STORM WINDOW LOCK

[75] Inventor: Norman G. Damiana, 13320 Winfield Pl., Golden, Colo. 80401

[73] Assignee: Norman G. Damiana, Denver, Colo.

[21] Appl. No.: 232,119

[22] Filed: Feb. 6, 1981

[51] Int. Cl.[3] ..... E05C 1/10

[52] U.S. Cl. ..... 292/175; 292/42; 292/DIG. 47

[58] Field of Search ..... 49/409, 449, 450; 292/42, 163, DIG. 47, 305, 32, 33, 40, 340, 175

[56] References Cited

U.S. PATENT DOCUMENTS

| | | | |
|---|---|---|---|
| 2,844,843 | 7/1958 | Logan | 292/305 X |
| 2,967,595 | 1/1961 | Zitomer | 49/450 |
| 3,173,180 | 3/1965 | Dean | 292/42 X |

*Primary Examiner*—Richard E. Moore

*Attorney, Agent, or Firm*—Crandell & Polumbus

[57] ABSTRACT

A lock for a storm window, a catch of the lock being adapted to fit within a track along which a positionable window slides to a closed position. Spring biased latches on the positionable window are automatically biased by the catch away from the track and received by a recess in the catch, which recess retains the latch and prevents movement of the positionable window.

1 Claim, 18 Drawing Figures

STORM WINDOW LOCK

BACKGROUND OF THE INVENTION

1. Field of Invention

The present invention relates to locks for spring biased latches for storm windows. More particularly, the present invention relates to catches for spring biased latches associated with storm windows.

2. Brief Description of the Prior Art

Vertically hung storm windows having a fixed window and a coplanar screen facing the outside of a building or a home with inside positionable windows are well known. The positionable window utilizes spring biased latches mounted into a bottom side of a sash of the window to engage any one of a plurality of notches positioned along a casing, into which the entire storm window is mounted. The latch extends into a notch to position the window and retracts from the notch to allow repositioning of the window. By varying the position of the positionable window, the extent to which outside air is allowed to mix with inside air through the screen is controlled.

It is desirable in having such a positionable window, that the window be capable of being locked from the inside, so as to secure the window from unauthorized break-ins. This has previously been accomplished by a tab bent out of the casing near the bottommost or closed position of the positionable window. The tab then interferes with the latch mechanism when it is desired to raise the positionable window. To raise the positionable window, the latches must be retracted.

The use of a tab to lock the positionable window has certain drawbacks. Mainly, in locking the positionable window at the bottommost position, the spring biased latches must be retracted in order to pass over the tab and then released to provide the desired interference lock. If the latches were retracted automatically as the positionable window was dropped to its bottommost position the window would lock as it was closed.

The prior art procedure whereby a tab is punched out of the storm window casing to provide the interference lock with the latch of the positionable window does not require extra parts to provide a locking feature to the storm window, but does require an additional manufacturing step. The tab is also subject to being impacted by the positionable window as it is dropped to the bottommost or closed position. As a result, the tab, which is merely bent aluminum, can break off.

In manufacturing a storm window casing, corner pieces fit into the four channel structural members forming the casing to join side members to top and bottom members. The present invention is a corner piece which serves to join the members as well as the lock for the latches, thereby combining these features in an economic and advantageous manner.

OBJECTS AND SUMMARY OF THE INVENTION

It is therefore the principal object of the present invention to provide a latch for a storm window lock that automatically locks a positionable window of a storm window upon closing.

It is a related object of the present invention to provide a latch that serves to provide a structural connection for the members of the storm window casing.

It is a further object of the present invention to provide a latch that is highly serviceable in everyday use, requiring little or no maintenance and long life.

In accordance with the objects of the invention, a catch or keeper for a positionable window spring biased latch of a vertically hung storm window is provided. The keeper fits at the two lowermost corners of the storm window casing, joining parallel side structural members of the casing to a bottom structural member. It is further understood that conventional constructions might include a horizontal window or slider having two sliding windows and a fixed window, i.e., a 3-lite slider, or a single fixed and single sliding window, i.e., a 2-lite slider. For slider-type windows, no notches are necessary.

The keeper has a generally vertically oriented locking arm that fits within an inner track of the side members forming the casing of the storm window. An integrally connected horizontal arm makes a right angle with respect to the locking arm and fits within the inner track of the bottom member forming a horizontal portion of the storm window casing.

The locking arm portion of the keeper has a downwardly sloping ramp adapted to engage a lock prong of a spring biased latch located along a bottom side of a positionable window sash. The ramp of the locking arm biases the latch inward on downward movement of the positionable window. As the sash of the positionable window is lowered even further to a closed position within the storm window casing, the lock prong is urged into a recess formed in the locking arm. Once the lock prong of the latch is in the recess, the positionable window cannot be raised without biasing the latch.

DESCRIPTION OF THE PREFERRED EMBODIMENT

Figure 1:
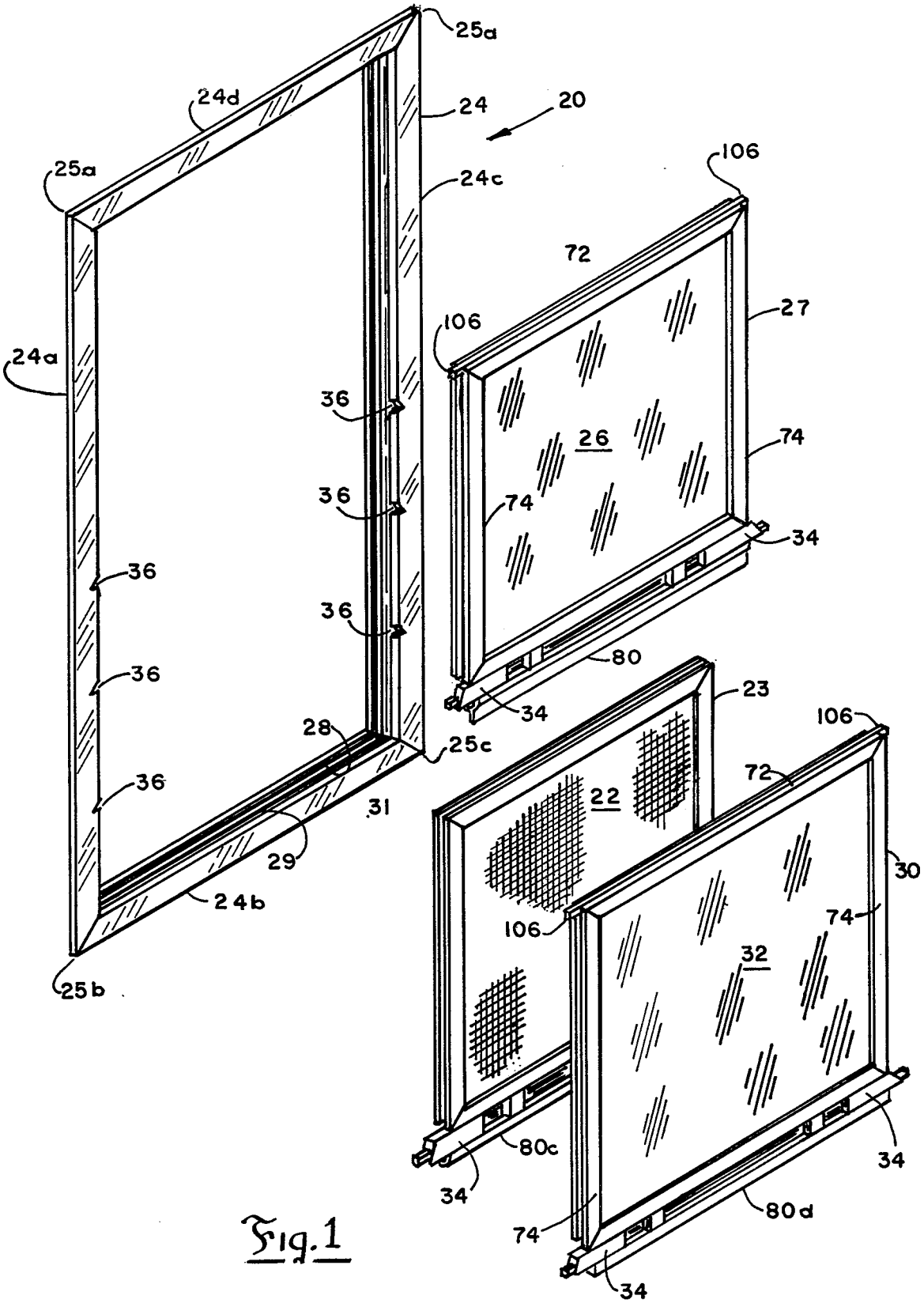
FIG. 1 is an exploded perspective view of a storm window with a catch of the present invention positioned in the lowermost corners of a storm window casing.

A storm window 20, seen in FIG. 1, of basically conventional vertically hung construction allows selective admission of outside air to the inside of a home or building through a screen 22 mounted within a screen frame 23. The screen covers approximately one half of the area defined by a storm window casing 24. The storm window casing 24 includes four generally linear extruded members 24*a*, 24*b*, 24*c* and 24*d* joined together at mitered corners 25*a*, 25*b*, 25*c* and 25*d*. The remaining area of the storm window casing 24 has a fixed window 26 mounted within a fixed window frame 27. The screen frame 23 and fixed window frame 27 are in contact with outside air and are aligned in an outer track 28 formed around the inner perimeter of the storm window casing 24. A sash 30 holds a positionable or sliding window 32, which window 32 is slideable along an inner track 29 formed around the inner perimeter of the storm window frame 24, adjacent to the outer track 28.

In the assembled configuration, the conventional storm window 20 therefore presents the fixed window 26 and screen 22 to the outside or exterior of a home or building. The sliding window 32 is positionable at various levels along the members 24*a* and 24*c* of the storm window casing 24, intermediate the inside of a home or building and the coplanar fixed window 26 and screen 22 exteriorly mounted with respect to the home or building.

A catch or keeper 31 of generally L-shaped configuration fits within the inner track 29 at mitered corners 25*b* and 25*c* to assist in interconnecting members 24*a*, 24*b* and 24*c* of the storm window casing 24 (FIGS. 1, 9, 10 and 11). A pair of latches 34 are slideably mounted on a bottom side 80*a* of sash 30, adjacent to member 24*b* when the sliding window 32 is closed, which latches retract along a line perpendicular to the direction of movement of the sliding window 32. As the sliding window 32 is dropped to its bottommost or closed position, the keeper 31 automatically locks both latches 34 of the sliding window 32 to prevent the sliding window 32 from being raised along its sliding path in inner track 29.

Figure 5:
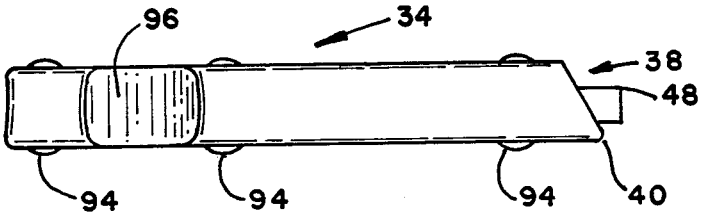
FIG. 5 is a top plan view of a latch for the storm windows shown in FIG. 1.
Figure 6:
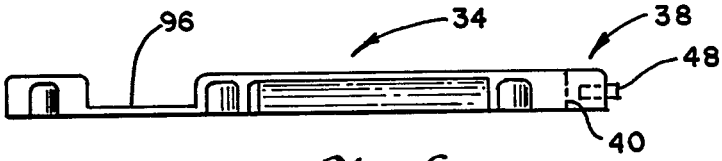
FIG. 6 is a side elevational view of the latch for the storm windows shown in FIG. 1.
Figure 8:
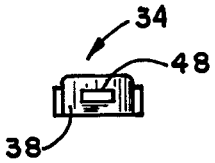
FIG. 8 is an end elevational view of the latch for the storm windows shown in FIG. 1.
Figure 7:
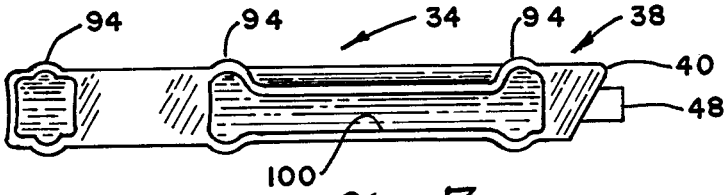
FIG. 7 is a bottom plan view of the latch of the storm window shown in FIG. 1.
Figure 9:
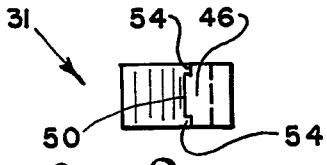
FIG. 9 is a top plan view of the catch shown in FIG. 1.
Figure 12:
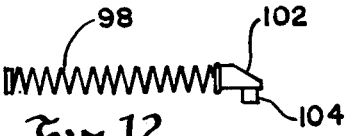
FIG. 12 is a side elevational view of a spring and lock mechanism associated with the latch of the storm window shown in FIG. 1.
Figure 13:
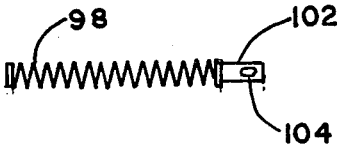
FIG. 13 is a bottom plan view of a spring and lock mechanism associated with the latch of the storm window shown in FIG. 1.
Figure 10:
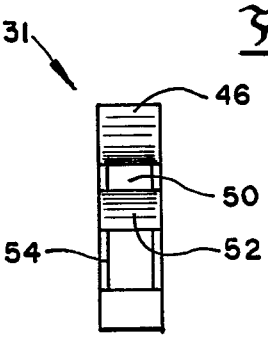
FIG. 10 is a front elevational view of the catch shown in FIG. 1.
Figure 11:
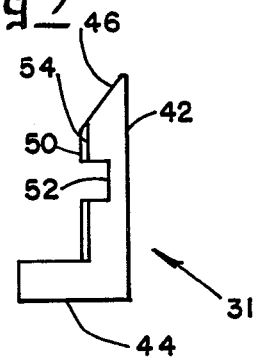
FIG. 11 is a side elevational view of the catch shown in FIG. 1.
Figure 15:
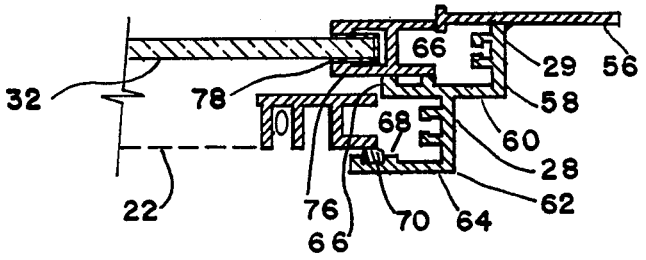
FIG 15 is an enlarged sectional view taken in the plane of line 15—15 of FIG. 2.
Figure 14:
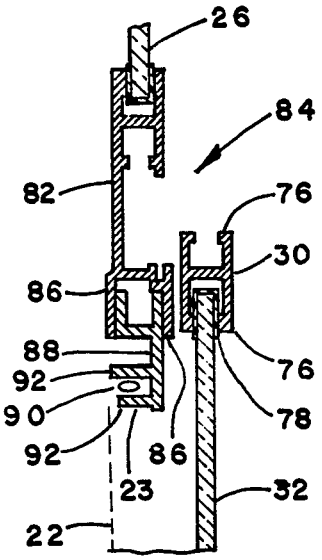
FIG. 14 is an enlarged sectional view taken in the plane of line 14—14 of FIG. 2.
Figure 16:
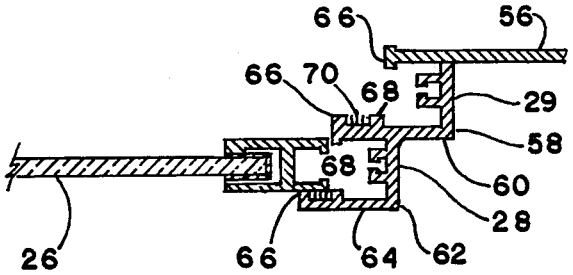
FIG. 16 is an enlarged sectional view taken in the plane of line 16—16 of FIG. 2.
Figure 17:
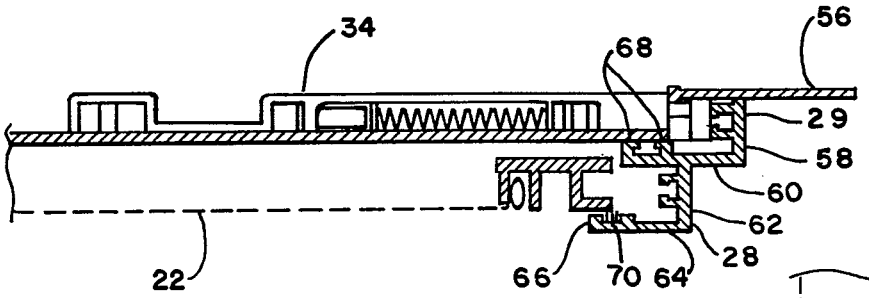
FIG. 17 is an enlarged sectional view taken in the plane of line 17—17 of FIG. 4.
Figure 18:
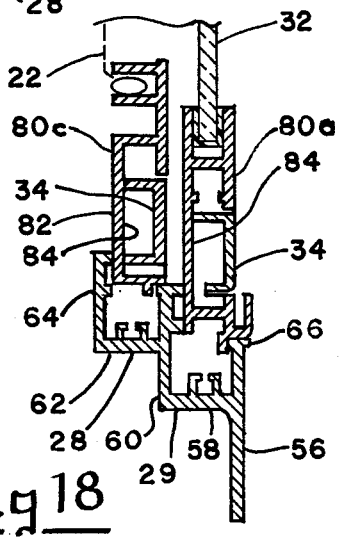
FIG. 18 is an enlarged sectional view taken in the plane of line 18—18 of FIG. 2.

As is the case with conventional vertically hung storm windows, the sliding window 32 utilizes the pair of latches 34 mounted onto the sash 30 to set the window position. Thus, more or less of the screen 22 is open between inside and outside air. Wedge-shaped notches 36 are formed in the storm window casing 24 at preset positions along members 24*a* and 24*c* (FIG. 1) on the inside of and along the inner tracks 29. Each latch 34 has at a projected end 38 a support edge 40 (FIG. 5) of wedge-shaped top plan view that has a corresponding shape to the notches 36, providing mating receipt between the edge 40 and the notches 36.

Figure 2:
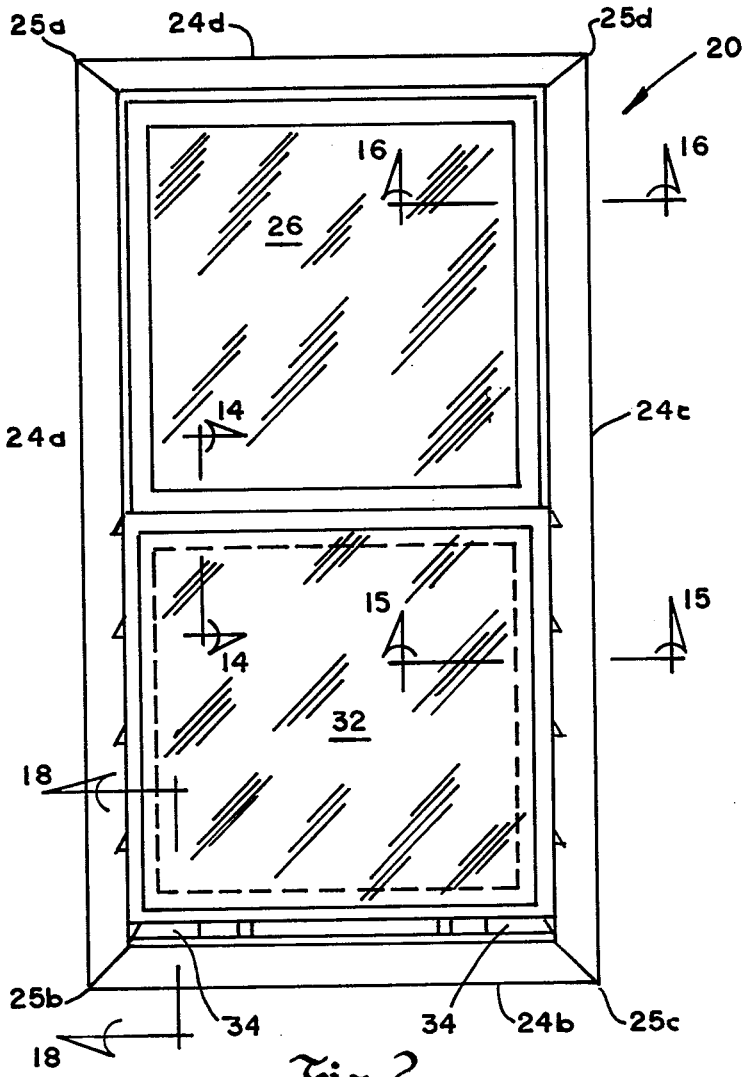
FIG. 2 is a rear elevational view of the storm window as it would appear looking from the inside to the outside.
Figure 3:
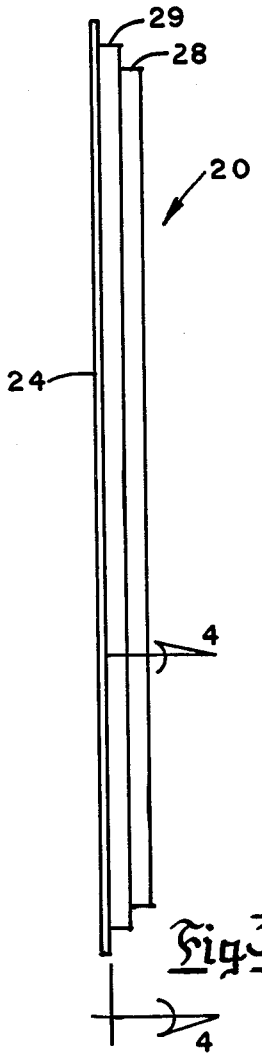
FIG. 3 is a side elevational view of the storm window.
Figure 4:
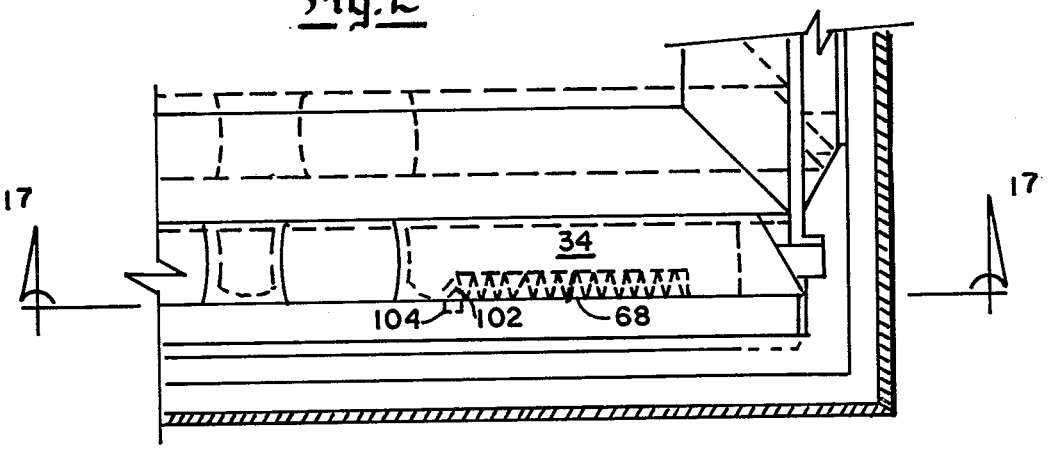
FIG. 4 is a fragmentary enlarged sectional view taken in the plane of line 4—4 of FIG. 3.

In operation, to change the position of the sliding window 32 from the position covering the entire screen 22 (FIG. 2), at which position the latches 34 are locked against sliding by the catch or keeper 31, the latches must be retracted relative to the keeper, and the sliding window raised. As the sliding window 32 is raised, the support edge 40 sequentially engages the notches 36. The wedge shape of the notch 36 and corresponding edge 40 are both directed downward, so that as the sliding window is raised, the notches automatically bias the latch 34 inward by the sliding engagement with similarly shaped edge 40. At an uppermost or fully open position, the sliding window 32 exposes the entire surface area of the screen 22 to mix outside and inside air. To lower the sliding window 32, both latches 34 are retracted, removing support edge 40 from the associated pair of notches 36 in members 24*a* and 24*c*, and the window is dropped under the force of gravity until the proper notch is located, or the locked position at the keeper 31 is reached.

The unique construction of the catch or keeper 31 locks the sliding window 32 from movement along the inner track 29 once the sliding window 32 is closed. The keeper 31 fits into the inner track 29 at both mitered corners 25*b* and 25*c* of the overall storm window casing 24 (FIG. 1). The keeper is an integral body of generally L-shaped configuration (FIGS. 9, 10 and 11) having a locking arm 42, disposed generally vertically and aligned along the direction of movement of the sliding window 32, and an anchor or horizontal arm 44 (FIG. 11), which arm 44 combines with arm 42 to fit the keeper in the corners 25*b* and 25*c* of the inner track 29.

Locking arm 42 of the keeper 31 is engaged by a latch 34 as the sliding window 32 descends along inner track 29. The edge 40 of the latch 34 is initially met by a downwardly and inwardly sloping ramp portion 46 of the keeper 31. As sliding window 32 moves downward, the latch 34 is biased inwardly by the sliding relationship between the edge 40 of the latch 34 and the ramp portion 46. Once the latch is biased away from the inner track 29, a generally rectangular locking prong 48 is met by the ramp portion 46, in a relationship that is maintained until the ramp portion ends.

At the position where the sliding window 32 nears its bottommost position, the ramp portion 46 ends in a relatively short, compared to the length of the locking arm 42, land portion 50. The land portion 50 is generally vertically oriented, lying in a plane parallel to the longitudinal axes of members 24*a* and 24*c*. The land portion receives the locking prong 48 from the ramp portion 46 and terminates in a latch recess 52. The latch recess 52 is an outwardly opening recess formed in locking arm 42 which opens perpendicularly to the direction of movement of the sliding window 32. The latch recess 52 receives the locking prong 48 of the latch 34 to thereby lock the sliding window 32 at that position.

From the foregoing, it is seen that the keeper 31 automatically locks the latches 34 to prevent movement of the sliding window 32 in the sliding direction. As the sliding window 32 is lowered to the closed position, each latch 34 is automatically biased by the engagement between the latch and the ramp portion 46 of the catch 31. Once the locking prong 48 is fitted within a recess 52, the sliding window 32 cannot be raised along the sliding direction. The horizontal arm 44 of the catch, which is locked into the inner track 29 of the member 24*b*, resists any movement of the sliding window 32 by being mounted in member 24*b*, unless the latch 34 is retracted.

The keeper 31 also assists in connecting and aligning frame members 24*a*, 24*b* and 24*c* (FIG. 1). Conventional construction would utilize a separate corner piece con-